US005635024A

United States Patent [19]

Shall

[11] Patent Number: 5,635,024

[45] Date of Patent: Jun. 3, 1997

[54] PROCESS FOR SEPARATING LIGNINS AND DISSOLVED ORGANIC COMPOUNDS FROM KRAFT SPENT LIQUOR

[75] Inventor: Hassan E. Shall, Valrico, Fla.

[73] Assignee: Bountiful Applied Research Corporation, Bountiful, Utah

[21] Appl. No.: 109,241

[22] Filed: Aug. 20, 1993

[51] Int. Cl.[6] ..... D21C 11/00

[52] U.S. Cl. ..... 162/16; 162/29; 210/705; 210/724; 210/725; 210/928

[58] Field of Search ..... 162/16, 29; 210/928, 210/705, 724, 725, 727

[56] References Cited

U.S. PATENT DOCUMENTS

| | | | |
|---|---|---|---|
| 3,546,200 | 12/1970 | Whalem et al. | 260/124 |
| 3,935,121 | 1/1976 | Lieberman et al. | 252/321 |
| 4,107,073 | 8/1978 | Maciaszek | 252/321 |
| 4,230,599 | 10/1980 | Elfers | 252/321 |
| 4,561,934 | 12/1985 | Rimpi | 162/30.11 |
| 4,921,613 | 5/1990 | Nordberg | 162/16 |
| 4,950,420 | 8/1990 | Svarz | 162/179 |

*Primary Examiner*—Donald E. Czaja
*Assistant Examiner*—Dean T. Nguyen
*Attorney, Agent, or Firm*—Mallinckrodt & Mallinckrodt

[57] ABSTRACT

Digestion liquor is used in the paper pulping process to dissolve lignins and free the cellulose fiber from raw wood chips. After pulping, spent digestion liquor is laden with lignins. Heretofore, it was known that lignins could be coagulated by acidification of the digestion liquor, but such method coagulated the lignins in a slimy gelatinous mass that was difficult to separate from the liquor. It has been discovered that the addition of water soluble, surface active, polymeric agents to the digestion liquor prior to acidification, results in an easily separable lignin coagulant after acidification.

15 Claims, 1 Drawing Sheet

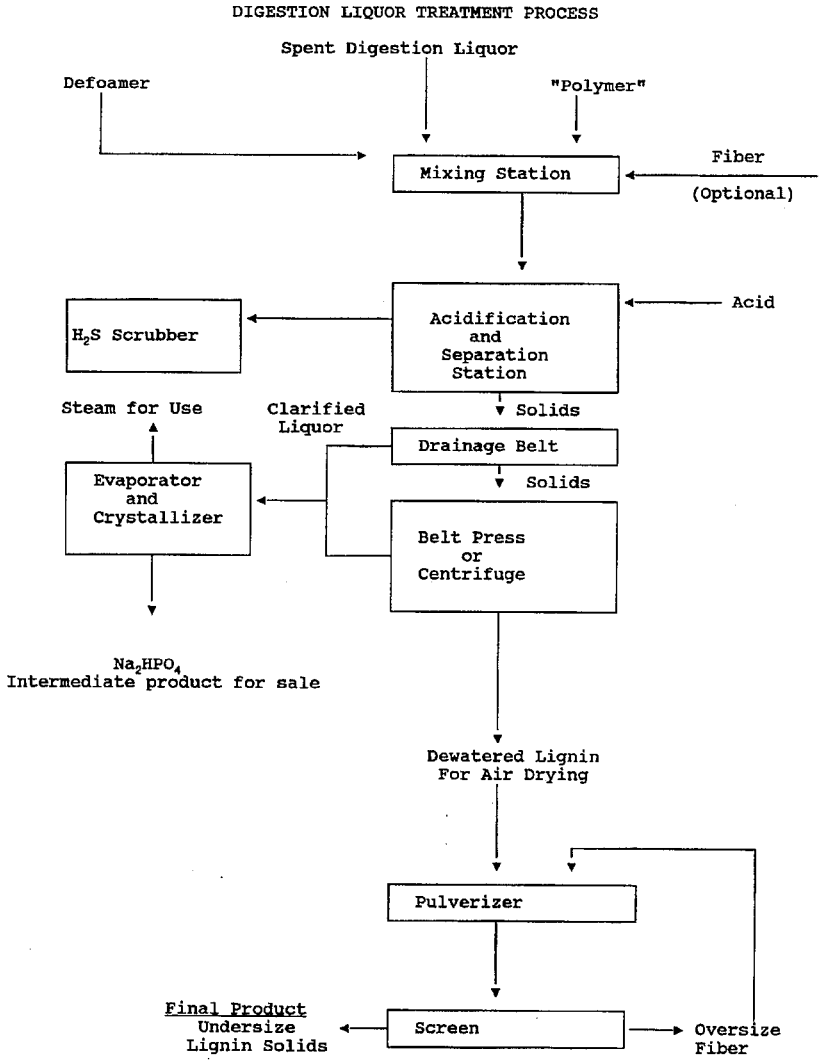

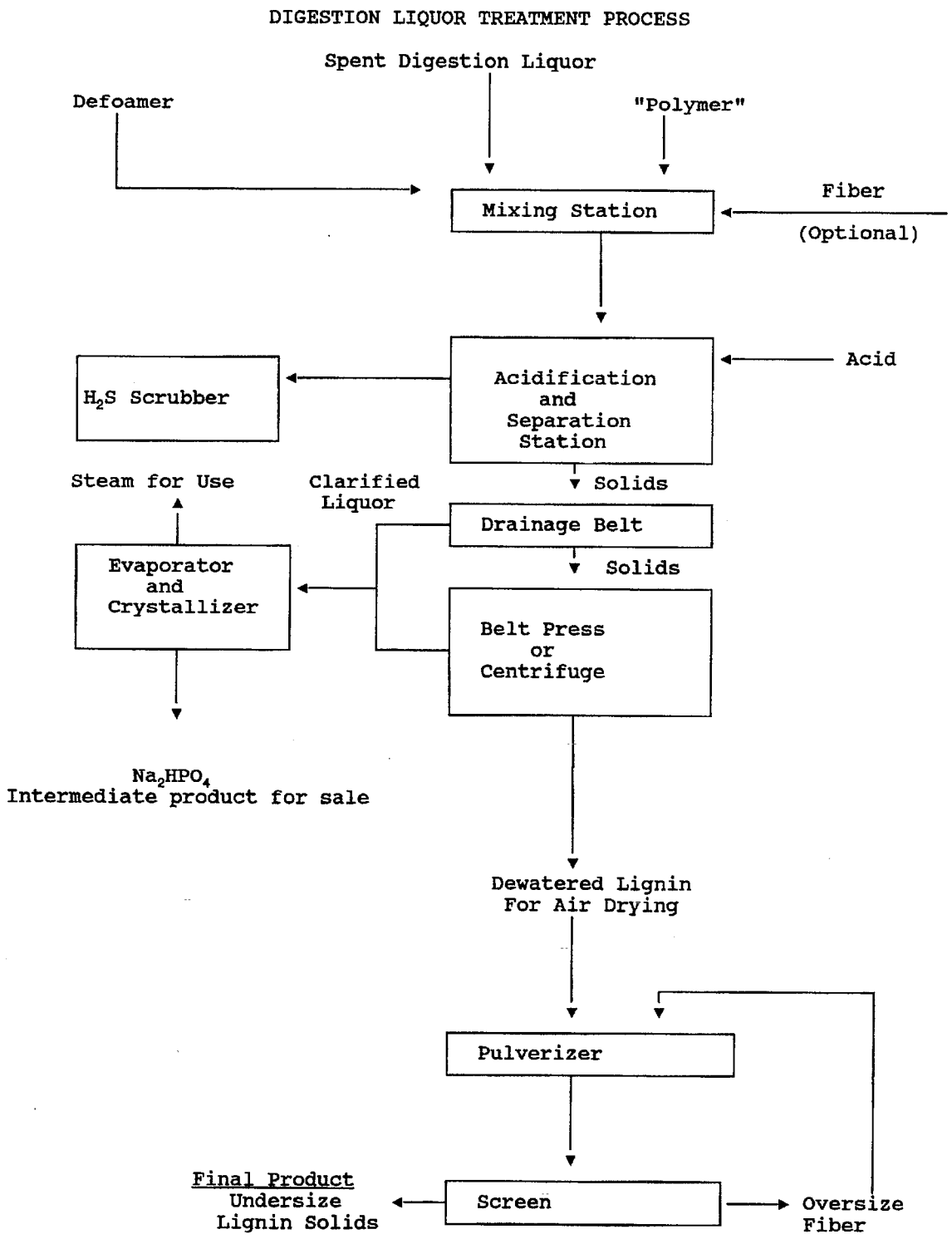
DIGESTION LIQUOR TREATMENT PROCESS
Spent Digestion Liquor
Defoamer
"Polymer"
Mixing Station
Fiber
(Optional)
Acidification and Separation Station
Acid
$H_2S$ Scrubber
Solids
Steam for Use
Clarified Liquor
Drainage Belt
Evaporator and Crystallizer
Solids
Belt Press or Centrifuge
$Na_2HPO_4$
Intermediate product for sale
Dewatered Lignin For Air Drying
Pulverizer
Final Product
Undersize Lignin Solids
Screen
Oversize Fiber

PROCESS FOR SEPARATING LIGNINS AND DISSOLVED ORGANIC COMPOUNDS FROM KRAFT SPENT LIQUOR

BACKGROUND OF THE INVENTION

1. Field

This invention is generally in the field of paper making, specifically in the field of coagulating and separating organic solids from liquors produced during the process of digesting raw materials in manufacture of pulp and paper.

2. State of the Art

Wood has been a primary source of cellulose fibers for paper making. Before use, the wood must be reduced to the fibrous state. This operation is called pulping. At present, commercial pulping operations are of three principal types: mechanical, full chemical, and semichemical. The process with which the invention is concerned is full chemical or semichemical pulping.

Full chemical pulping employs chemical reagents to effect a separation of the cellulose fibers from the other wood components. Wood chips are cooked with suitable chemicals in aqueous solution, usually at elevated temperatures and pressures. The object is to dissolve the organic binders termed "lignins", comprising up to 26% of the wood, along with other saccharide type organic molecules and other extraneous compounds, leaving the cellulose intact and in fibrous form. Though there is some cellulose degradation, the objective can be realized to a commercially satisfactory degree through the use of a variety of chemical reagents. Pulp yields are usually about 50% of the wood weight.

The kraft or sulfate process and the semikraft process are commonly employed. Here, the active pulping ingredients are sodium hydroxide, sodium carbonate, and sodium sulfide comprising an obviously strongly alkaline solution. Standard in kraft pulping is a liquor-recovery cycle, in which the dissolved organic constituents in the spent pulping liquors are burned for steam generation, and the inorganic pulping chemicals are recovered and reused.

The traditional digestion liquor recovery cycle consists of the step of evaporating the liquor to a high concentration, to a so-called "black liquor" or "black kraft liquor" which is about 70% solids. Other processes, such as vacuum flashing, may then be performed to increase solids even more. This high-solids content kraft black liquor is usually fed into a furnace, where black liquor combustibles are burned for energy recovery. The salts therein are collected in molten form from the furnace for recycle into the pulping process.

This process is disadvantageous because it requires a high capital cost plant investment and considerable energy consumption to effect evaporation to 70% or higher solids. The furnaces themselves are hazardous, and, in addition, there is the hazard of handling molten salt pools.

It has long been known that acidification of kraft black liquor to a pH of about 2 to 3 causes precipitation of an acid lignin in slimy, gelatinous form. In such form, it is difficult to separate by centrifugation, settling, or decanting. David M. Whalen described a simple method for precipitating lignin from kraft black liquor in Vol. 58, No. 5, May 1975 TAPPI Journal, pages 110–112. Whalen described a process whereby kraft black liquor is added slowly and with stirring to a mixture of an organic liquid, such as chloroform, and enough mineral acid to bring the final pH to about 2. The process was successful on a laboratory scale, but the large amounts of organic liquid required made the process impractical on a commercial scale. A more efficient way of separating out the lignins is still needed.

SUMMARY OF THE INVENTION

In the making of the present invention, it was a principal object to avoid the evaporation of spent digestion liquors to roughly 70% solids and to overcome the afore-explained problems in the separating out of lignins from acidified digestion liquor.

This objective has been accomplished by the addition to such "spent" or "used" digestion liquors of a relatively inexpensive water soluble, surface active, polymeric agent, referred to hereinafter as "polymer", during or before the acidification of such liquors.

The "polymers" have molecular weights ranging from about five millions to about twenty-five million. Such agents comprise anionic polymers, such as copolymers of acrylamide and acrylic acid (or sodium acrylate), or partially hydrolyzed polyacrylamide and homopolymers or copolymers of sulfonic acid and acrylamide, and are available as commercial products such as Percol 919 and Percol 156 from Allied Colloids, Inc., and Nalco 7877 from Nalco Chemicals Company; nonionic polymers based on polyacrylamide chemistry or polyethylene oxides such as Percol 351, Percol 802, and PEO available from Allied Colloids, Inc.; and cationic polymers of different charge densities such as Percol 368, Percol 292, and Percol 2802. However, nonionic polymers are preferred.

These "polymers" are added to bring concentration thereof to in the range of about 0.05 to 1.0 percent in the liquor. To achieve such percentage range, the agents are added from about 0.1 to about 5.0 pound/ton of dry organic material in the digestion liquor. The preferred level of addition is about one pound per ton.

As the acidification of such digestion liquors can lead to the generation of gases, depending on the alkaline salt used in the pulping process, it is also preferred to add defoaming agents to reduce excessive foaming. Defoaming agents comprise water soluble, surface active agents, such as fatty acids, sulfonated fatty acids, or soaps of fatty acids, polysilicones, and succinates which have a carbon chain containing about eight carbons to about 18 carbons. These defoaming agents are added from about 0.01 to about 1.0 pound per ton of liquor. The preferred level of addition is about 0.1 pound per ton of liquor.

Once the water soluble, surface active, polymeric agent and the defoamer are in place the digestion liquor is acidified to a pH below 7, preferably to at least about 3. In a concentrated liquor, this causes the lignins to coagulate and float to the top of the liquor. There, the lignins can be easily separated by screening the top of the liquor or filtering. In a non-concentrated liquor, the lignins coagulate, stay suspended, but are still easily separated, such as by filtration. The removed solids are washed for removal of residual salts, and thereafter dewatered and dried. The dry solids are suitable for burning in a furnace for energy recovery. Digestion salts remain in the purified liquor and are available for regeneration to be used again in digestion.

DRAWING

The best mode presently contemplated for carrying out the invention commercially is illustrated in the accompanying drawings, in which:

The single figure is a schematic diagram showing the steps employed in performing a method for treatment of spent digestion liquor.

DETAILED DESCRIPTION OF THE ILLUSTRATED EMBODIMENT

The details of which water soluble, surface active, polymeric agents will work and how much is added to a quantity of spent digestion liquor are presented above and will not be repeated here. Selection of the preferred "polymer" may depend somewhat on the source of the lignin, i.e., the particular raw material being pulped. For example, for hardwood pulping liquors, the nonionic "polymer" PERCAL 351, available from Allied Colloids, Suffolk, Va. is superior. Other pulping liquors for softwood, baggasse, and rice stalks, for example, may be best separated using different polymers.

Turning to the drawing, the diagrammatic showing is of a preferred embodiment of the generic process of the invention for treating spent digestion liquors and the lignins recovered therefrom.

The spent digestion liquor laden with lignins is passed into a mixing station where a "polymer" is added and preferably a defoaming agent. This station can be a static station or of the continuous type. Optionally, fiber is added as well to aid coagulation and separation.

From this station, the conditioned liquor is passed to another station for its acidification with an acid, preferably sulfuric acid or phosphoric acid. Organic acids may be used in combination with mineral or inorganic acids as may be appropriate for process needs. Hydrogen sulfide gas will be generated upon acidification if sodium sulfide is contained in the alkaline salt used for pulping. Preferably, this station is enclosed and has conducting means for conducting such gas to a hydrogen sulfide gas scrubber, as indicated. Upon acidification, coagulation of the lignins also commences. These float to the surface of the spent digestion liquor and can be screened off and into a dewatering station, such as a drainage belt. Much of the liquid is separated from the solids by passing through the aperatures of the drainage belt. The dewatering station preferably further includes a belt press or centrifuge, where even more liquid is removed. A fresh water wash can be used to displace salts carried in the solids. The liquid removed at the dewatering station is preferably passed to an evaporator. If phosphoric acid is used for acidification, crystallization is preferably employed to separate a crystallized salt such as disodium phosphate, which can be sold. Steam given off from the evaporator can be put to use. The liquor clarified of lignins is preferably evaporated to a salt concentration of 35% to 40% and is returned to the digestion station (not shown).

Alternatively, the "clarified" digestion liquor that has been evaporated to 35% to 40% salt with its low molecular weight organics concentration can be used as a fermentation broth to make ethyl alcohol. Information and suitable bacteria to perform the fermentation are available from the Laboratory for Renewable Energy Sources, a Department of Energy operation, in Golden, Colo.

Solids from the belt press or centrifuge comprise primarily dewatered lignins, which can be air dried. Once dried, the lignins are passed through a pulverizer and screened. Undersize lignins can be used as fuel. Oversize lignins can be passed through the pulverizer again.

To evaluate the digestion liquor treatment process, two identical samples were acidified, one without a water soluble, surface active, polymeric agent and one with. To the first sample, there was added a sufficient quantity of the water soluble, surface active, polymeric agent, hereinafter the "polymer-treated sample". Both polymer-treated sample and a control were then acidified with sulfuric acid. Precipitates were formed and were removed by filtration. It was noted that the precipitate that formed in the polymer-treated sample coagulated and floated to the top and was easily separated from the "clarified" digestion liquor, that is "clarified" of lignins. The precipitate in the untreated sample was in a slimy gelatinous form and was not easily separated. In addition, the polymer-treated sample produced 75% more dried precipitate than the control sample.

Table I shows the organic and inorganic (ash), as well as total solids distribution between precipitate and filtrate for both samples.

TABLE I

COMPONENT DISTRIBUTION BETWEEN PRECIPITATE AND FILTRATE

| | Control | Polymer-treated |
|---|---|---|
| | Precipitate | |
| % of Total Organics | 44.4 | 63.7 |
| % of Total Ash | 13.1 | 20.0 |
| % of Total Solids | 30.1 | 46.9 |
| | Filtrate | |
| % of Total Organics | 55.6 | 36.3 |
| % of Total Ash | 86.9 | 80.0 |
| % of Total Solids | 70.0 | 53.1 |

Whereas this invention is here illustrated and described with reference to embodiments thereof presently contemplated as the best mode of carrying out such invention in actual practice, it is to be understood that various changes may be made in adapting the invention to different embodiments without departing from the broader inventive concepts disclosed herein and comprehended by the claims that follow.

I claim:

1. A process for treating a spent Kraft alkaline digestion liquor containing lignins and liquid, comprising the steps of:

(a) mixing into said spent Kraft digestion liquor a water soluble, surface active, polymeric coagulant agent;

(b) acidifying the spent digestion liquor of step (a) to a pH below 7 to cause lignins and other dissolved organic compounds of the spent digestion liquor to coagulate as solids and float to the surface of the spent digestion liquor; and (c) separating the coagulated solids and the residual liquid of the acidified spent digestion liquor, one from the other.

2. A process according to claim 1, wherein a defoaming agent is added to the spent digestion liquor prior to the acidification thereof.

3. A process according to claim 2, wherein the defoaming agent is added in the amount of about 0.01 pound per ton of liquor to bring concentration thereof to about 1.0 pound per ton of liquor.

4. A process according to claim 1, wherein the water soluble, surface active coagulant agent is nonionic.

5. A process according to claim 4, wherein the nonionic, water soluble, surface active coagulant agent is a polyacrylamide in the molecular weight range of from about five million to about twenty-five million.

6. A process according to claim 4, wherein the nonionic, water soluble, surface active coagulant agent is polyethylene oxide.

7. A process according to claim 1, wherein the spent digestion liquor is obtained from a hardwood pulping process.

8. A process according to claim 1, wherein the spent digestion liquor is obtained from a softwood pulping process.

9. A process according to claim 1, wherein the water soluble, surface active polymeric coagulant agent is added to bring concentration thereof to in the range of about 0.05 to about 1.0 percent by weight in the liquor.

10. A process according to claim 1, wherein the polymeric agent is added to the digestion liquor before acidification of said liquor.

11. A process according to claim 1, wherein the polymeric agent is added to the digestion liquor during acidification of said liquor.

12. In a process according to claim 1, wherein the solids and the residual liquid; are used as valuable products.

13. A process according to claim 12, wherein a valuable solid product is a salt of the acid used for acidification; and the residual liquid is subjected to evaporation and to crystallization of said salt.

14. A process according to claim 13, wherein the acid is phosphoric and the salt obtained is disodium phosphate.

15. A process for treating a kraft spent alkaline digestion liquor containing lignins and liquid, comprising the steps of:

(a) mixing into said kraft spent digestion liquor a water soluble, surface active, polymeric coagulant agent;

(b) acidifying the spent digestion liquor of step (a) to a pH of about 3.0, whereby the lignins and other dissolved organic compounds of the spent digestion liquor coagulate as solids and float to the surface of the spent digestion liquor; and (c) separating the coagulated solids and the residual liquid of the acidified spent digestion liquor, one from the other.

* * * * *

UNITED STATES PATENT AND TRADEMARK OFFICE

CERTIFICATE OF CORRECTION

PATENT NO. : 5,635,024

DATED : June 3, 1997

INVENTOR(S) : Hassan El Shall

It is certified that error appears in the above-identified patent and that said Letters Patent is hereby corrected as shown below:

Title page, column 1, the inventor's name "Shall" is corrected to "El Shall" and again "Hassan E. Shall" is corrected to "Hassan El Shall" and, under "References Cited", the name of the patentees of Patent No. 3,546,200 is corrected from "Whalem et al." to "Whalen et al."

Signed and Sealed this

Twenty-fourth Day of March, 1998

*Attest:*

Bruce Lehman

BRUCE LEHMAN

*Attesting Officer*

*Commissioner of Patents and Trademarks*